US009085741B2

(12) United States Patent
Giardino et al.

(10) Patent No.: US 9,085,741 B2
(45) Date of Patent: Jul. 21, 2015

(54) MIXED ALCOHOL FUELS FOR INTERNAL COMBUSTION ENGINES, FURNACES, BOILERS, KILNS AND GASIFIERS AND SLURRY TRANSPORTATION

(71) Applicants: Geradette Giardino, Arvada, CO (US); Robert M. Jimeson, Vienna, VA (US); Mark C. Radosevich, Arvada, CO (US); Rex R. Stevens, Grand Junction, CO (US)

(72) Inventors: Geradette Giardino, Arvada, CO (US); Robert M. Jimeson, Vienna, VA (US); Mark C. Radosevich, Arvada, CO (US); Rex R. Stevens, Grand Junction, CO (US)

(73) Assignee: STANDARD ALCOHOL COMPANY OF AMERICA, Arvada, CO (US)

( * ) Notice: Subject to any disclaimer, the term of this patent is extended or adjusted under 35 U.S.C. 154(b) by 485 days.

(21) Appl. No.: 13/621,408

(22) Filed: Sep. 17, 2012

(65) Prior Publication Data

US 2013/0019519 A1 Jan. 24, 2013

Related U.S. Application Data

(63) Continuation-in-part of application No. 12/498,850, filed on Jul. 7, 2009, now Pat. No. 8,277,522, which is a continuation-in-part of application No. 11/060,169, filed on Feb. 17, 2005, now Pat. No. 7,559,961, which is a continuation-in-part of application No. 10/124,665, filed on Apr. 17, 2002, now Pat. No. 6,858,048.

(51) Int. Cl.

| | |
|---|---|
| ***C10L 1/18*** | (2006.01) |
| ***C10L 10/02*** | (2006.01) |
| ***C10L 1/02*** | (2006.01) |
| ***C10L 1/182*** | (2006.01) |
| ***C10L 1/32*** | (2006.01) |
| ***C10L 9/10*** | (2006.01) |
| ***C10L 10/00*** | (2006.01) |

(52) U.S. Cl.

CPC . *C10L 10/02* (2013.01); *C10L 1/02* (2013.01); *C10L 1/023* (2013.01); *C10L 1/026* (2013.01); *C10L 1/1822* (2013.01); *C10L 1/1824* (2013.01); *C10L 1/322* (2013.01); *C10L 9/10* (2013.01); *C10L 10/00* (2013.01); *C10L 2230/14* (2013.01)

(58) Field of Classification Search

CPC ..... C10L 10/02; C10L 1/02; C10L 1/023; C10L 1/026; C10L 1/1822; C10L 1/1824; C10L 1/322; C10L 9/10; C10L 10/00; C10L 2230/14

See application file for complete search history.

(56) References Cited

U.S. PATENT DOCUMENTS

| | | | | |
|---|---|---|---|---|
| 2,128,910 | A | | 9/1938 | Bludworth |
| 3,822,119 | A | | 7/1974 | Frech |
| 3,968,999 | A | | 7/1976 | Keller |
| 4,018,293 | A | | 4/1977 | Keller |
| 4,030,893 | A | | 6/1977 | Keller |
| 4,045,092 | A | | 8/1977 | Keller |
| 4,089,657 | A | | 5/1978 | Keller |
| 4,097,217 | A | | 6/1978 | Keller |
| 4,146,366 | A | | 3/1979 | Keller |
| 4,154,580 | A | * | 5/1979 | Landis ..... 44/452 |
| 4,192,651 | A | | 3/1980 | Keller |
| 4,218,516 | A | | 8/1980 | Meyer et al. |
| 4,298,354 | A | | 11/1981 | Hardman et al. |
| 4,357,146 | A | | 11/1982 | Heeren |
| 4,366,032 | A | | 12/1982 | Mikitenko et al. |
| 4,384,872 | A | | 5/1983 | Kester et al. |
| 4,479,807 | A | | 10/1984 | Rebandt |
| 4,533,508 | A | | 8/1985 | Stevens |
| 4,561,861 | A | | 12/1985 | Davis et al. |
| 4,675,344 | A | | 6/1987 | Conway et al. |
| 4,705,532 | A | | 11/1987 | Mazanec et al. |
| 4,752,622 | A | | 6/1988 | Stevens |
| 4,752,623 | A | | 6/1988 | Stevens |
| 4,762,858 | A | | 8/1988 | Hucul et al. |
| 4,825,013 | A | | 4/1989 | Quarderer et al. |
| 4,831,060 | A | | 5/1989 | Stevens et al. |
| 4,871,397 | A | | 10/1989 | Stevens |
| 4,882,360 | A | | 11/1989 | Stevens |
| 4,895,662 | A | | 1/1990 | Stevens |
| 4,953,479 | A | | 9/1990 | Keller et al. |
| RE33,562 | E | | 4/1991 | Badger |

(Continued)

FOREIGN PATENT DOCUMENTS

| | | |
|---|---|---|
| CN | 1089299 | 7/1994 |

OTHER PUBLICATIONS

"The Economical Production of Alcohol Fuels From Coal-Derived Synthesis Gas", Quarterly Technical Progress Report No. 18, W. Virginia Univ. Research Corp., Apr. 1996, 15 pgs.

"Dow Develops Catalytic Method to Produce Higher Mixed Alcohols", Technology, Nov. 12, 1984, pp. 29-30.

"Mixed Alcohols From Synthesis Gas", Dow Chemical, M.J. Mintz and G.J. Quarderer, pp. 1-21.

"Evaluation of Synthesis Gas Based High Octane Oxygenates", (The Mised Alcohols Option), Absel Elsaway and David Gray, Nov. 1988, pp. 119-136.

Letter with enclosures from Lurgi GMBH to Wayne Kreis of The Texas Methanol Corp., dated Jan. 19, 1987, ref: Octamix-Sample Shipment of Jan. 17, 1987, Frankfurt, Germany, 3 pgs.

*Primary Examiner* — Cephia D Toomer

(74) *Attorney, Agent, or Firm* — Geoffrey A. Mantooth; Brian K. Yost

(57) ABSTRACT

Mixed alcohol formulas can be used as a fuel additive in petroleum-based hydrocarbon liquid fuels, synthetic or bio-derived gasoline, diesel fuels, jet fuel, aviation gasoline, heating oil, bunker oil, coal, petroleum coke, heavy crude oil, bitumen, or as a neat fuel in and of itself. The mixed alcohol formulations can be blended with ground petroleum coke, coal, heavy crude oil, or bitumen to form a thixotropic slurry for ease of transportation. The mixed alcohol formulations can also be used to shurry transport ground biomass. The mixed alcohol formulations can contain a blend of $C_1$-$C_5$ alcohols, or $C_1$-$C_8$ alcohols or higher $C_1$-$C_{10}$ alcohols in order to further boost energy content.

22 Claims, No Drawings

(56) References Cited

U.S. PATENT DOCUMENTS

| | | | |
|---|---|---|---|
| 5,045,087 | A | 9/1991 | Keller |
| 5,288,393 | A | 2/1994 | Jessup et al. |
| 5,559,275 | A | 9/1996 | Barger |
| 5,653,866 | A | 8/1997 | Jessup et al. |
| 5,663,455 | A | 9/1997 | Harris et al. |
| 5,720,784 | A | 2/1998 | Killick et al. |
| 5,837,126 | A | 11/1998 | Jessup et al. |
| 6,030,521 | A | 2/2000 | Jessup et al. |
| 6,039,772 | A | 3/2000 | Orr |
| 6,858,048 | B1 | 2/2005 | Jimeson et al. |
| 7,559,961 | B2 | 7/2009 | Jimeson et al. |
| 8,641,788 | B2 * | 2/2014 | Lamoureaux et al. ..... 44/452 |
| 2010/0024288 | A1 | 2/2010 | Jimeson et al. |

* cited by examiner

MIXED ALCOHOL FUELS FOR INTERNAL COMBUSTION ENGINES, FURNACES, BOILERS, KILNS AND GASIFIERS AND SLURRY TRANSPORTATION

This application is a continuation-in-part of application Ser. No. 12/498,850, filed Jul. 7, 2009, which is a continuation-in-part of application Ser. No. 11/060,169, filed Feb. 17, 2005, now U.S. Pat. No. 7,559,961, which application was a continuation-in-part of Ser. No. 10/124,665, filed Apr. 17, 2002, now U.S. Pat. No. 6,858,048.

FIELD OF THE INVENTION

The present invention relates to mixed alcohol fuels used in internal combustion engines, furnaces, boilers and gasifiers in particular blended into gasoline fuels, aviation gasoline, diesel fuels, jet fuels, heating oil fuels, bunker oil fuels, synthetic or bio-produced fuels, heavy crude oils, bitumen, ground petroleum coke and coal, as well as the transport thereof. Additionally, the mixed alcohol fuels may be utilized neat as a substitute fuel or as a higher BTU substitute for fermented ethanol or lingo-cellulosic ethanol when blended with gasoline. The mixed alcohol fuels may also be utilized as a thinning and transportation agent when blended into extra thick or heavy crude oils or tar sands bitumen heavy oils, or solids of petroleum coke or ground coal thus making it easier to transport in a pipeline or otherwise tanker transport these thick, hydrocarbon substances.

BACKGROUND OF THE INVENTION

Internal combustion engines are commonly used on mobile platforms (to propel vehicles such as cars, trucks, airplanes, motorcycles, jet skis, snowmobiles), in remote areas (such as for oil well pumps or electric generators) or in lawn and garden tools (such as lawnmowers, weed-eaters, chainsaws, and more). There are various types of internal combustion engines, furnaces, boilers, kilns and gasifiers.

Spark type engines utilize a volatile fuel, such as gasoline. A spark plug provides the source of ignition. A typical fuel is gasoline as either reformulated to meet mandated urban air quality standards or a non-oxygenated gasoline typically sold in rural areas. High performance spark type engines are sometimes tuned to operate on pure methanol or ethanol. Compression type engines take in air and compress it to generate the heat necessary to ignite the liquid fuel. Typical high compression engines also utilize longer-chained petroleum-based diesel fuel, synthetically produced diesel fuel or bio-diesel fuels produced from either animal fats or plant oils.

When gasoline is burned, it produces pollutants in the form of hydrocarbons (HC), including nitrogen oxides (NOx), carbon monoxide (CO) and soot (particulates). In addition, gasoline in warm climates tends to evaporate due to the presence of volatile organic compounds (VOCs).

Internal combustion diesel engines are commonly used in vehicles operating both on-road for transportation and in off-road configurations for construction.

Furnaces and boilers are typically used for home or space heating, electrical generation or propulsion of large ships. Kilns are drying devices. Smaller kilns are used in the manufacture of pottery and ceramics. Larger kilns are used to dry lumber or to manufacture cement. Gasifiers are devices which convert solid carbonaceous fuels into synthesis gas mainly CO & $H_2$ which is either combusted for heat or electricity, or further catalyzed into liquid chemical or fuel products.

When refined petroleum fuels, heavy crude oils, bitumen, petroleum coke or coal are combusted, these hydrocarbons produce pollutants which include nitrogen oxides (NOx), carbon monoxide (CO) and soot (particulates). Nitrogen oxides and volatile organic components react together in sunlight to form ground level ozone, a component of smog. Diesel has less of a tendency to evaporate than does gasoline. Lower distillate crude oils, bitumen, heating oils, bunker oils, coke or coal have even less tendency to evaporate VOC's.

In areas of high use, such as heavy automobile traffic, exhaust emissions from internal combustion engines, furnaces, boilers or kilns plus evaporation from the fuel tanks result in significant air pollution. In some urban areas, a brown haze of pollution frequently remains within the first several hundred feet off of the ground.

Alcohol fuels have come into use for internal combustion engines as a biodegradable, oxygenated fuel to further increase combustion efficiencies of petroleum-derived fuels in order to reduce harmful emissions. In the 1970's, gasohol, a blend of mostly gasoline with some fermented ethanol, was introduced in the United States during the Arab oil embargo to extend supplies of domestic gasoline. Unfortunately, at that time, many of the elastomeric engine seals, hoses and gasket components were designed only for gasoline or diesel and deteriorated with the use of solvent ethanol. Since then, engines, gaskets and fuel delivery systems have become equipped with fluorinated elastomers, which are tolerant to the greater solvent characteristics of oxygenated alcohol fuels.

Currently in 2012, the primary alcohol fuel is ethanol, which is typically fermented from grain (corn, wheat, barley, oats, sugar beets or sugar cane). Other versions of ethanol are now being produced through conversion of lignin and cellulose obtained from plant stalks or wood chips and termed as ligno-cellulosic ethanol employing extra acidic enzymes, a longer fermentation cycle and typically outputting only about ⅓ the ethanol volumes of fermented corn kernels or via gasification of lignin and cellulose conversion of syngas to ethanol.

The ethanol is typically blended into gasoline in various quantities. "Premium" gasoline, with a higher (Research Octane+Motor Octane)/2 (also known as (R+M)/2) octane rating than "regular" gasoline, is primarily gasoline with 10% to 15% volumes of ethanol ($C_2$ alcohol). Another ethanol fuel is E-85, which is 85% ethanol and 15% gasoline. Still another alcohol fuel is M-85, which is 85% methanol ($C_1$ alcohol) and 15% gasoline.

Grain ethanol is expensive to produce. Ligno-cellulosic ethanol is even more expensive to produce. Furthermore, producing sufficient quantities of grain ethanol to satisfy the needs of the transportation industry is not practical because traditional food crops are diverted into fuel. Traditionally, governments have heavily subsidized grain ethanol. Droughts and government policy towards farming in general (less intervention and payments to farmers) make the supply of grain ethanol's availability and future uncertain and expensive.

In addition, both ($C_1$) methanol and ($C_2$) ethanol (defined as lower alcohols) have less energy content when compared to gasoline. Methanol contains about 56,000 BTU's/gallon and ethanol contains about 75,500 BTU's/gallon while gasoline contains about 113,000 BTU's/gallon. A motorist notices this when a vehicle running on gasoline achieves more miles per gallon than does the same vehicle running on a blend of gasoline and lower alcohol fuels.

Oxygenated fuels are blended to reduce harmful combustion emissions from petroleum-based liquid hydrocarbon gasoline, diesel fuel, jet fuel, lower distillate petroleum fuels, ground coke and coal solid hydrocarbons to reduce particulate soot, uncombusted hydrocarbons and carbon monoxide. Furthermore, larger quantities of a higher energy content, oxygenated alcohol fuel are needed than can be produced from grain, sugar cane, lignin and cellulosic batch fermentation of biomass.

In the broader energy field, there is also a growing need to inexpensively transport solid hydrocarbon materials such as coal and petroleum coke, and also heavy crude oils and bitumen from locations where they are produced to locations where they can be combusted or cleanly gasified for their thermal value. Transport by rail, truck or barge is costly and cumbersome.

SUMMARY OF THE INVENTION

A water content reduction method for coke or coal is provided. A quantity of mixed alcohols is provided. The mixed alcohols comprise by volume: 0.01-55% methanol, 0.01-80% ethanol, 0.01-35% propanol, 0.01-30% butanol and 0.01-20% pentanol. The mixed alcohols are mixed with coke or coal. The coke or coal contains water with at least some of the water mixing with the mixed alcohols. A portion of the mixed alcohols are removed from the coke or coal, wherein the water moisture of the coke or coal is reduced.

In accordance with another aspect, the coke or coal is ground to pass through a 100 mesh before mixing with the mixed alcohols.

In accordance with still another aspect, the mixed alcohols that are provided further comprises: 0.01-15% hexanol, 0.01-13% heptanol and 0.01-10% octanol.

In accordance with still another aspect, the mixed alcohols further comprises by volume: 0.01-6% nananol and 0.01-5% decanol.

In one aspect, a transportation method for coke, coal, heavy crude oil, bitumen or biomass is provided. A quantity of mixed alcohols is provided, which comprises by volume: 0.01-55% methanol, 0.01-80% ethanol, 0.01-35% propanol, 0.01-30% butanol and 0.01-20% pentanol. The mixed alcohols is mixed with the coke or coal to form a slurry. The slurry is transported in a pipeline or tanker by rail, barge, truck or ship.

In accordance with another aspect, the step of mixing the mixed alcohols with ground coke or coal further comprises mixing 30% to 70% by weight of the mixed alcohols into the coke or coal. In accordance with still another aspect, the step of providing mixed alcohols further comprises providing by volume: 0.01-15% hexanol, 0.01-13% heptanol and 0.01-10% octanol.

In accordance with another aspect, the step of providing mixed alcohols further comprises providing by volume: 0.01-6% nananol and 0.01-5% decanol.

In accordance with still another aspect, a portion of the mixed alcohols are removed from the transported coke or coal.

In accordance with still another aspect, the transported coke or coal is combusted or cleanly gasified.

DESCRIPTION OF THE PREFERRED EMBODIMENTS

The present invention provides mixed alcohols which are mixed with coke or coal, heavy crude oils or bitumen, to produce a shiny. The slurry is easily transported through pipelines or tankers to a destination such as a power plant operation combustion steam boiler, a gasifier, or further refined in energy production. In addition to producing transportable slurry, the mixing of the mixed alcohols with coke or coal reduces the water moisture of the coke or coal.

The mixed alcohols are largely removed from the coke or coal; however some residual amount of the mixed alcohols may remain. This residual amount of mixed alcohols increases the BTU value, in addition, the residual mixed alcohols introduces oxygen into the combustion process wherein the combustion efficiency is increased and fewer harmful emissions are produced.

Furthermore, the mixed alcohols can be used as an additive to gasoline-based fuels, aviation gasoline, diesel-based fuels, jet fuels, heating oils, bunker oils, heavy crude oils or thick bitumen for use in internal combustion engines. In addition, the mixed alcohols can be combusted "neat," that is without blending into gasoline, diesel or jet fuel or heavier hydrocarbon fuels.

When used as an additive to gasoline-based fuels, the mixed alcohols can be used as a substitute for MTBE, MMT, lead and/or for grain ethanol or ligno-cellulosic ethanol as an octane booster. The gasoline-based fuel is either reformulated or non-reformulated gasoline or mixed alcohols. The mixed alcohols also function as an oxygenate providing increased combustion efficiency to the base hydrocarbon fuels.

The mixed alcohols also function to minimize water contamination of fuels. The mixed alcohol fuel, when combusted in an internal combustion engine, reduces hydrocarbon and carbon monoxide emissions, while having an increased octane number and a more compatible with gasoline Reid Vapor Pressure. In addition, carbon deposits on engine intake valves, exhaust valves, pistons and the combustion chambers of the furnaces, kilns, gasifiers or combustion boilers are significantly reduced.

When used as an additive to gasoline, diesels, such as petroleum-based diesel, synthetic diesel and/or biodiesel (plant oils or animal fats), the mixed alcohols function as an oxygenate for more efficient combustion. The present invention provides a diesel-based oxygenated fuel which can be used in internal combustion engines. The diesel-based fuel is diesel and mixed alcohols. The fuel, when combusted in an internal combustion engine, produces increased torque and reduces exhaust emissions. A unique property of a blend of higher mixed alcohols is that these longer-chained higher alcohols as a volumetric blend will solubilize with and enhance the combustion efficiencies of both liquid and solid fuels while binding tightly with water.

The diesel can be obtained from a variety of sources. Petroleum diesel is obtained from crude oil. Biodiesel is obtained from plant oils and/or animal fats. Synthetic diesel, just like synthetic higher alcohols, can be obtained from coal, methane natural gas, $CO_2$, biomass, such as woodchips, garbage, sewage or natural gas; a biomass-to-liquid (BTL) process or gas-to-liquid (GTL) process may be used.

When the higher mixed alcohols are combusted "neat," without gasoline, jet fuel or diesel, the internal combustion engine exhibits the increase in torque and reductions in exhaust emissions.

The mixed alcohols fuels can be used in a variety of 4-stroke and 2-stroke internal combustion engines powering automobiles, trucks, aircraft, stationary or in transportation turbines and smaller engines such as those used in motorcycles, ATV's, lawnmowers, jet skis, snowmobiles and handheld power tools such as chainsaws or weed-eaters.

Currently the ethanol based fuel E-85 is used in flexible fuel vehicles (FFV). The mixed alcohol fuels can be used in such FFV-equipped vehicles. Slight tuning or automatic adjustment of the engine's spark ignition timing and air/fuel ratio will provide extra power and even lower emission profiles.

The blend of mixed alcohols contains predominantly single-chained molecular alcohols having different numbers of carbon atoms. There are various types of alcohols, which are classified according to the number of carbon atoms. For example, methanol ($C_1$) has one carbon atom, ethanol ($C_2$) has two carbon atoms, n-propanol or iso-propanol ($C_3$) has three carbon atoms and so on. The alcohols are preferably normal and are designated with a prefix of (n), such as n-propanol, n-butanol, n-pentanol. Although the present invention discusses normal straight-chain alcohols, iso-alcohols such as iso-butanol could be used in a mixed alcohols formulation as well.

The mixed alcohols of the present invention comprise a number of alcohols. Typically, methanol and ethanol together comprise over 50% by volume of the mixed alcohols with other higher alcohols and small amounts of non-alcohol components making up the remainder. A typical mixture of mixed alcohols is, by volume:

0.01-55% methanol 0.01-80% ethanol 0.01-35% propanol 0.01-30% butanol 0.01-20% pentanol. (I)

Another mixture of mixed alcohols is, by volume:

0.01-55% methanol 0.01-80% ethanol 0.01-35% propanol 0.01-30% butanol 0.01-20% pentanol 0.01-15% hexanol 0.01-13% heptanol 0.01-10% octanol. (II)

Still another mixture of mixed alcohols is, by volume:

0.01-55% methanol 0.01-80% ethanol 0.01-35% propanol 0.01-30% butanol 0.01-20% pentanol 0.01-15% hexanol 0.01-13% heptanol 0.01-10% octanol 0.01-6% nananol 0.01-5% decanol. (III)

Formula II of mixed alcohols contains $C_1$-$C_8$. This formula II is most commonly used with gasoline. In one embodiment, the fuel contains at least 5% of volume of the mixed alcohols and the octane number of the gasoline is greater than 90. In another embodiment, the fuel contains 5-50% by volume mixed alcohols.

In another embodiment, the formula III is used with gasoline.

Typically, the amount of ethanol exceeds the amount of methanol in blends of mixed alcohols. In fact, the mixed alcohols may contain the highest proportion of ethanol, with the other alcohols comprising smaller proportions. Ethanol provides more energy density than does methanol. Typically, the energy density increases with the increasing carbon content in the higher alcohols. The higher alcohols $C_3$-$C_8$ (propanol, butanol, pentanol, hexanol, heptanol and octanol) provide more energy density than do the lower alcohols ethanol and methanol.

Traditionally, the use of ethanol as an additive to petroleum-based fuels has resulted in a blended fuel which displays a lower energy density (measured in BTU/lb or BTU/gal) than does petroleum-derived fuel without ethanol. Thus, the miles per gallon which can be achieved by a typical internal combustion engine powered vehicle is slightly lower when using an ethanol and hydrocarbon-based fuel blend (such as gasoline) than when using fuel without ethanol. However, with the present invention, the use of higher alcohols $C_3$-$C_8$ increases the energy density of the alcohol mixture. Thus, less BTU energy loss is incurred when using the mixed alcohols as a fuel additive. In fact, the mixed alcohols can contain higher alcohols such as $C_9$, $C_{10}$ and this blend of higher mixed alcohols in gasoline typically improves fuel mileage economy while creating a highly reduced emissions profile.

The use of $C_6$-$C_8$ or $C_6$-$C_{10}$ alcohols, while preferred, is optional. Thus, the mixed alcohols blended into gasoline can contain $C_1$-$C_2$ alcohols only or a mixture of any two or more of the alcohols in the $C_1$-$C_5$ range. Upon combustion, mixed $C_1$-$C_5$ alcohols in combination with gasoline, produces lower emissions of hydrocarbons and carbon monoxide relative to gasoline-only type fuels. The mixed alcohols ($C_1$-$C_2$ or $C_1$-$C_5$ or $C_1$-$C_8$ or $C_1$-$C_{10}$) can be blended manually by providing the various components in the proper proportions. Alternatively, the mixed alcohols can be synthesized in large commercial quantities. For example, the mixed alcohols can be produced by passing synthesis gas over a potassium-promoted $CoSMoS_2$ catalyst from 1,200 to 1,500 psig and 250 to 400 degrees C. This process is more fully described in U.S. Pat. Nos. 4,752,622 and 4,882,360.

The mixed alcohols can contain some slight impurities due to the manufacturing process. Such impurities include esters, water and trace amounts of hydrocarbons. These impurities can be removed if required by the particular application or left within the blend of mixed alcohols.

This mixture of both higher ($C_3$ plus) and lower alcohols ($C_1$ and $C_2$) when synthetically produced will typically have a greater volume of ethanol than any other alcohol contained within the blend. The mixed alcohol chain of propanol to octanol or decanol typically is produced in a descending volumetric order and provides a greater energy density of 90,400 BTU's/gallon when compared to ethanol at 75,500 BTU's/gallon or methanol at 56,000 BTU's/gallon.

While advantageous to utilize this entire mixture of lower and higher mixed alcohols either neat or as a blendstock to petroleum-based fuels, synthetically-derived liquid fuels or bio-derived (plant oils or animal fat) fuels produced through transesterification or depolymerization techniques, the blend of mixed alcohols may also be fractionalized and distilled into individualized alcohol components.

For certain applications either neat or as a blendstock, mixed alcohols may be further defined as a mixture of two or more component alcohols characterized by either "normal" (straight-chain molecular configurations) or as "iso" as a branched alcohol molecule. Isolating individual components from this blend of mixed alcohols can be achieved by fractional distillation. Then, the individual alcohols may be mechanically re-combined to form a mixture of methanol and ethanol only, or a blend of ethanol, propanol and butanol only, or other selections. While this technique of isolating component alcohols and re-blending only a portion of them is expensive, for certain applications it may be deemed appropriate. Thus mixed alcohols can be broadly defined as a blend of two or more component alcohols be they straight-chain normal alcohols or iso-branched alcohols produced either through batch fermentation or gas-to-liquids (GTL) methods of thermal catalytic synthesis.

Note that the mixed alcohols are a solvent in which water, oil, coal, petroleum coke, heavy crude oils, bitumen and fuels produced from hydrocarbons are soluble. Methanol has long been added to gasoline and propane tanks to solubilize with condensate water. When there is too much water however, the methanol-bound water can phase-separate from the hydrocarbon-base fuel. This can cause engine problems such as engine stalling. An engine or furnace can tolerate some water in the fuel, so long as it is well mixed. The use of the higher alcohols ($C_3$-$C_8$ or $C_3$-$C_{10}$) serves to mitigate separation of the contaminant water in the fuel. A blend of higher alcohols will solubilize and bind condensate water much tighter than conventional, lower $C_1$ or $C_2$ alcohols.

The mixed alcohols in accordance with formula I can be blended into gasoline, diesel fuel and jet fuel, as well as aviation gasoline, heating oil, bunker oil, petroleum coke or coal. In addition, the mixed alcohols of formula I can be used neat. The mixed alcohols of formulas II and III can be blended into gasoline, diesel fuel, jet fuel, aviation gasoline, heating oil, bunker oil, petroleum coke or coal and can be used neat as well.

When used with diesel, the mixed alcohol of formula I comprises 2-30% of the diesel fuel by volume.

Still another formula of mixed alcohols is:

Any two alcohols selected from the group of, by volume:

0.01-55% methanol 0.01-80% ethanol 0.01-35% propanol 0.01-30% butanol 0.01-20% pentanol. (IV)

For example, such a mixture can contain an ethanol or methanol plus another alcohol, such as $C_2$ and $C_3$, or $C_2$ and $C_4$, or $C_2$ and $C_5$, or $C_1$ and $C_3$, and other selections. Such a mixture can also contain alcohols higher than methanol and ethanol, such as $C_3$ and $C_4$, $C_3$ and $C_5$ or $C_4$ and $C_5$.

Another formulation of mixed alcohols is:

Any three alcohols selected from the group, by volume:

0.01-55% methanol 0.01-80% ethanol 0.01-35% propanol 0.01-30% butanol 0.01-20% pentanol. (V)

For example, such a mixture can contain $C_1$, $C_2$ and $C_3$; or $C_2$, $C_3$ and $C_4$; or $C_3$, $C_4$ and $C_5$, or $C_2$, $C_4$ and $C_5$, or other selections.

Other formulas of mixed alcohols are:

Any two alcohols selected from the group, by volume:

0.01-55% methanol 0.01-80% ethanol 0.01-35% propanol 0.01-30% butanol 0.01-20% pentanol 0.01-15% hexanol 0.01-13% heptanol 0.01-10% octanol. (VI)

Any three alcohols selected from the group, by volume:

0.01-55% methanol 0.01-80% ethanol 0.01-35% propanol 0.01-30% butanol 0.01-20% pentanol 0.01-15% hexanol 0.01-13% heptanol 0.01-10% octanol. (VII)

Any two alcohols selected from the group, by volume:

0.01-55% methanol 0.01-80% ethanol 0.01-35% propanol 0.01-30% butanol 0.01-20% pentanol 0.01-15% hexanol 0.01-13% heptanol 0.01-10% octanol 0.01-6% nananol 0.01-5% decanol. (VIII)

Any three alcohols or more selected from the group, by volume:

0.01-55% methanol 0.01-80% ethanol 0.01-35% propanol 0.01-30% butanol 0.01-20% pentanol 0.01-15% hexanol 0.01-13% heptanol 0.01-10% octanol 0.01-6% nananol 0.01-5% decanol. (IX)

Sample of Mixed Alcohols Formula Percentage Conversion Weight and Volume

| Alcohol | Symbol | Density g/mL | Volume mL wt/density | Percentage weight | Percentage volume |
|---|---|---|---|---|---|
| Methanol | C1 | 0.7914 | 21.61 | 17.10 | 17.21 |
| Ethanol | C2 | 0.7893 | 62.03 | 48.96 | 49.39 |
| Propanol | C3 | 0.8035 | 20.91 | 16.80 | 16.65 |
| Butanol | C4 | 0.8098 | 8.66 | 7.01 | 6.89 |
| Pentanol | C5 | 0.8144 | 5.03 | 4.10 | 4.01 |
| Hexanol | C6 | 0.8136 | 3.07 | 2.50 | 2.45 |
| Heptanol | C7 | 0.8219 | 1.72 | 1.41 | 1.37 |
| Octanol | C8 | 0.8270 | 1.33 | 1.10 | 1.06 |
| Nananol | C9 | 0.8273 | 0.74 | 0.61 | 0.59 |
| Decanol | C10 | 0.8297 | 0.49 | 0.41 | 0.39 |
| | | | 125.59 | 100.00 | 100.00 |

Start with weights, divide by the density to obtain volume. Complete the calculation and obtain the volume percentages by dividing each volume by the sum of all the volumes (normalizing) and and multiply by 100 to get the percentage.

These formulas IV-IX can be used as substitutes for formulas with gasoline, diesel fuel, jet fuel, aviation gasoline, neat, heating oil, bunker oil, crude oil, thick bitumen, petroleum coke or coal.

When using two or more alcohols, the alcohols can be mechanically mixed or combined. For example, production of alcohols through a gas-to-liquids process using intermediate synthesis gas and specific catalysis may result in a mixture of $C_1$-$C_8$ alcohols. The alcohols can be separated, such as by fractionalization or distillation. Then, the desired alcohols can be recombined.

Generally speaking, gasoline, jet, aviation gasoline, and diesel fuels are primarily derived from crude oil and contain additives. Gasoline, jet fuel, aviation gasoline and diesel are all well known fuels. Jet fuel contains kerosene. Aviation gasoline typically contains tetraethyl lead. Heating oil, grades 1 or 2, is used to heat homes or other structures. Lower distillate Bunker oil, grades A, B or C, is traditionally combusted in large ocean-going ships. Crude oil or thick bitumen such as that extracted from tar sands may be combusted neat in electrical power plant steam boilers or refined into a variety of liquid distillate fuels. Petroleum coke and coal are typically combusted in furnaces, kilns and boilers. Petroleum coke and coal also are used as process feedstocks for gasifiers.

The mixed alcohols can be blended with gasoline so as to make a blended fuel. The blended fuel can contain 0.01-99% by weight of mixed alcohols with the remainder being gasoline. Such a blended fuel features an enhanced octane. The mixed alcohols are a more effective octane enhancer than is either MTBE or ethanol for gasoline. Additionally, the higher alcohols feature a greater energy density than either ethanol or MTBE. The mixed alcohols are biodegradable in land and water environments. This is unlike MTBE, which persists and pollutes land and water environments. Mixed alcohols can be used as a direct replacement or substitute for MTBE in gasoline. Thus, when mixed alcohols are used in gasoline, MTBE need not be added to that gasoline.

In addition, the mixed alcohols can substitute for E-85 fuel blends (which are 85% grain ethanol or ligno-cellulosic ethanol and 15% gasoline). E-85 fuel blends are used in flex-fuel equipped factory designed internal combustion engines, called Flex Fueled Vehicles (FFV's).

The gasoline is preferably unleaded gasoline, which is conventional and commercially available and marketed as reformulated or non-reformulated varieties. Gasoline is a well-known fuel comprising mixtures of aromatics, olefins and paraffins. Gasoline may be known in some countries by other terms, such as petrol. The boiling points of these hydrocarbons are typically 77-360 degrees Fahrenheit. Gasoline may also include additives, such as detergents, anti-icing agents, demulsifiers, corrosion inhibitors, dyes, deposit modifiers and octane enhancers (such as tetraethyl lead or MMT). As discussed above, global gasoline supplies are preferably unleaded (that is, containing little or no tetraethyl lead or MMT).

There are several different blends of unleaded gasoline currently refined and sold throughout the world. These are conventional gasoline, winter oxygenated gasoline and reformulated gasoline. Conventional gasoline is formulated with a lower Reid Vapor Pressure (RVP) in order to evaporate more slowly in hot weather thereby reducing smog. Winter oxygenated and reformulated gasolines may contain MTBE or may contain ethanol to produce a cleaner burning fuel. Winter gasolines typically feature higher Reid Vapor Pressures (up to 12 psi or higher) to assist with cold starts. Summer gasolines typically feature 8 psi Reid Vapor Pressure ratings.

The mixed alcohols can be used as a substitute for MTBE and/or ethanol in gasoline, such as reformulated gasoline and/or winter oxygenated gasoline.

In addition, conventional commercial gasoline typically has an octane number between 85 and 90. So called regular gasoline has an octane number (R+M)/2 of about 87 when sold at sea level or 85 octane when sold at higher elevations, while premium gasoline has an octane number typically greater than 90. The octane number is a measure of the resistance of the gasoline to premature detonation in the engine. Premature detonation wastes the energy in the fuel and can harm the engine. An engine which knocks or pings during operation is experiencing premature detonation. Using a gasoline with a higher octane number typically lessens or eliminates the knocking or pinging problem.

Mixed alcohols enhance the octane number of the petroleum-based or bio-derived hydrocarbon oil-based fuels. This is particularly advantageous for aviation gasoline. Aviation gasoline is typically gasoline having a higher octane number (100 or greater) than automotive gasoline. Tetraethyl or tetramethyl lead is added to gasoline in order to produce the higher octane number required for aviation gasoline. Tetraethyl lead used to be added to automotive gasoline in order to raise the octane number. However, the use of lead in gasoline has been all but eliminated in the United States, Canada and several developed countries, with the common exception of aviation gasoline. Thus, the use of mixed alcohols can enhance the octane number of gasoline in order to produce aviation gasoline, without the use of harmful, poisonous lead.

In a preferred embodiment having a somewhat lower BTU range, tests were conducted on the following mixture of mixed alcohols, by volume:

28.6% methanol 47.0% ethanol 14.4% n-propanol 3.7% n-butanol 2.5% n-pentanol 3.8% esters (I)

The esters were methyl acetate (1.9%) and ethyl acetate (1.9%). The oxygen mass concentration for the above mixed alcohols is 34%.

When 5% volume of mixed alcohols containing $C_1$-$C_5$ alcohols were blended with 85 octane heptane and iso-octane reference fuels, which contained no other oxygenate, the (R+M)/2 blending octane number of the mixed alcohols was measured as 109. It is believed that the neat (R+M)/2 octane measurement number of higher mixed alcohols can exceed 135 under different blending conditions and volumetric concentrations. Test methods ASTM D 2699 and 2700 were used to determine octane number.

The Reid Vapor Pressure (RVP) of the mixed alcohols is low to mid-range. RVP is a measure of a fuel's propensity to vaporize or evaporate. The higher the RVP, the more vaporization occurs. A lower RVP is preferred to prevent vapor lock and reduce evaporative emissions (such as summertime evaporation of fuel from fuel tanks). A higher RVP is preferred in cold seasons to improve cold starts of engines. Reformulated gasoline has an RVP of between 6.4-10.0 psi. The measured RVP of the mixed alcohols $C_1$-$C_5$ is 4.6 psi (using test method ATSM D 5191). The blending RVP's of MTBE and pure ethanol are 8-10 psi and 17-22 psi, respectively. Measured RVP of mixed alcohols may differ from their blending RVP. Some reformulated gasolines currently require 2% by weight of oxygen in the fuel. It is believed that the blending of the mixed alcohols into gasoline will not significantly raise the RVP of the blended gasoline. Experiments have shown that when greater volumes (such as 25% volumes) of mixed alcohols are blended into gasoline the RVP of gasoline remains essentially unchanged. 10% volumes of higher mixed alcohols may raise the RVP of gasoline upwards by 0.6 to 1 psi. Thus, the mixed alcohols can raise the oxygen content of the fuel without significantly raising the RVP. This, coupled with more energy density than competing oxygenates are two of the primary commercial strengths of higher mixed alcohols.

The volumetric energy content of the mixed alcohols ($C_1$-$C_5$) alone is lower than unoxygenated gasoline. However, the energy content of the mixed alcohols is greater than E-85. It is believed that by incorporating $C_6$-$C_8$ alcohols into the mixed alcohols, the energy density will grow even closer to that of gasoline. Thus, the use of mixed alcohols $C_1$-$C_8$ or $C_1$-$C_{10}$ with gasoline will provide greater oxygen content, higher BTU, more efficient combustion and reduced emission when compared to the use of $C_1$-$C_5$ blends. A vehicle using a 10% volume blend of mixed alcohols $C_1$-$C_8$ and gasoline will provide about the same or even greater miles per gallon as when combusting gasoline alone.

The use of mixed alcohols and gasoline reduces intake valve deposits (IVD), exhaust valve deposits (EVD) and combustion chamber deposits (CCD). As the concentration of mixed alcohols increases relative to gasoline, the carbon deposits further decrease. Furthermore, there is not a problem with hydrocarbon sludge or varnish buildup in the engine's fuel system when using mixed alcohols. Engine oil lubricants may need to be changed to a lubricant which is better adapted to acidic combustion products.

Emission characteristics will now be described. Emission characteristics were obtained by combusting two fuels separately in a 3.8 L Buick LeSabre. The fuels were gasoline alone and a blend of 15% $C_1$-$C_5$ mixed alcohols (see (I) above) and 85% gasoline. The tests were performed in accordance with the U.S. Federal Test Procedure (FTP). The FTP refers to Code of Federal Regulations, Volume 40, "Protection of the Environment", herein incorporated by reference in its entirety. The engine was tuned to combust the gasoline alone. No adjustments were made to combust the blended fuel of mixed alcohols and gasoline.

A Clayton Model ECE-50 passenger dynamometer with a direct drive variable inertia flywheel system was used for testing. The inertia weight simulates equivalent weights of vehicles from 1000 pounds to 4875 pounds in 125-pound increments. The inertia weight and horsepower settings for the dynamometer were 3750 lb and 7.2 hp, respectively.

A positive displacement-type constant volume sampling system (CVS) was used to dilute the vehicle exhaust before collecting emission samples. A 10-inch diameter by 12-foot long stainless steel dilution tunnel was used with the CVS.

The vehicle hood was maintained fully open during all cycles, and was closed during the soak (turned off) periods. A cooling fan of 5,000 cfm was used in front of the test vehicle to provide air flow during all of the tests. During soaks, the fan was turned off.

For emission testing, the vehicles were operated over the Urban Dynamometer Driving Schedule (UDDS). The UDDS is the result of more than ten years of testing by various groups to translate the Los Angeles smog-producing driving conditions to dynamometer operations, and is a non-repetitive driving cycle covering 7.5 miles in 1372 seconds with an average speed of 19.7 mph. The maximum speed is 56.7 mph. An FTP consists of a cold start, 505 seconds, cold transient phase, followed immediately by an 867 seconds, stabilized phase. Following the stabilized phase, the vehicle was allowed to soak for ten minutes with the engine turned off before proceeding with a hot start, 505 seconds, hot transient phase to complete the test.

The emissions are mathematically weighted to represent the average of several 7.5 mile trips made from hot and cold starts. Exhaust emissions for the FTP cover the effects of vehicle and emission control system warm-ups as the vehicle is operated over the cycle. The stabilized phase produces emissions from a fully warmed up or stabilized vehicle and an emission control system, "Hot start" or "hot transient" phase emissions result when the vehicle and emission control systems have stabilized during operations, and are then soaked (turned off) for ten minutes.

Several of the regulated emissions (HC, CO) were reduced when the engine used the blend of mixed alcohols and gasoline. For gasoline alone, the total hydrocarbon emissions (THC) were 0.058-0.059 grams (g) per mile, while for the blend of mixed alcohols and gasoline, THC emissions were 0.032-0.070 grams per mile. Some of the THC emissions comprised methane. The non-methane hydrocarbon (NMHC) emissions were 0.049-0.054 grams per mile for gasoline alone and 0.030-0.067 grams per mile for the blend of mixed alcohols and gasoline. The CO emissions were 0.573-0.703 grams per mile for gasoline alone and 0.285-0.529 grams per mile for the blend of mixed alcohols and gasoline. The NOx emissions were 0.052-0.058 grams per mile for gasoline and 0.059-0.063 grams per mile for the blend of mixed alcohols and gasoline. Thus, the use of mixed alcohol significantly decreased carbon monoxide emissions, decreased hydrocarbon emissions and only slightly increased NOx emissions.

The use of mixed alcohols and gasoline slightly increased emissions of formaldehyde and acetaldehyde relative to gasoline alone. The formaldehyde emissions were 0.781-0.859 milligrams (mg) per mile for gasoline alone and 0.900-1.415 mg per mile for mixed alcohols and gasoline. The acetaldehyde emissions were 0.126-0.294 mg per mile for gasoline alone and 0.244-0.427 mg per mile for mixed alcohols and gasoline. It is believed that the presence of esters in the mixed alcohols contributed to the increase in formaldehyde and acetaldehyde. The esters can be removed from the mixed alcohols to reduce these emissions.

The mixed alcohols can be blended with jet fuel so as to make a blended fuel. Jet fuel is primarily kerosene with additives. The blended fuel can contain 0.01-30% by volume of the mixed alcohols, with the remainder being jet fuel. An attractive aspect of the mixed alcohols is that they solubilize condensate water which develops in the head space above jet fuel while pilots are flying at extra cold high altitudes.

The mixed alcohols can be blended with diesel so as to make a blended fuel. The blended fuel can contain 0.01-30% by volume of mixed alcohols with the remainder being diesel, synthetic diesel or bio-diesel. Diesel is a well-known fuel.

A mixed alcohols-diesel fuel blend containing 10% ($C_1$-$C_5$) mixed alcohols (see (I) above) and 90% petroleum-derived diesel fuel was tested. The results were as follows:

| Test Parameter | Test Method | Result |
|---|---|---|
| Specific Gravity | ASTM D 4052 | 0.7514 |
| Carbon/Hydrogen (wt %) | ASTM D 5291 | 80.86/12.92 |
| Cetane Number | ASTM D 613 | 43.4 |
| Sulfur Content | ASTM D 2622 | 354 PPM |
| Oxygen Content | ASTM D 5599 | 1.16 wt % |
| Heat of Combustion | ASTM D 240 | BTU/lb |
| Gross | | 1,9079.9 |
| Net | | 1,7933.1 |
| HFRR | ASTM D6079 | 205 microns |
| Boiling Distribution | ASTM D86 | ° F. |
| IBP | | 147.2 |
| 5% | | 175.3 |
| 10% | | 340.0 |
| 15% | | 404.1 |
| 20% | | 423.5 |
| 30% | | 445.7 |
| 40% | | 469.9 |
| 50% | | 490.9 |
| 60% | | 512.2 |
| 70% | | 534.7 |
| 80% | | 559.1 |
| 90% | | 590.9 |
| 95% | | 615.6 |
| FBP | | 631.9 |
| Recovered % | | 98.3 |
| Loss % | | 0.5 |
| Residue % | | 1.2 |

The use of mixed alcohols in diesel will reduce the particulates produced during combustion. In addition, it is believed that regulated emissions (hydrocarbons, carbon monoxide and nitrogen oxides) will be reduced.

In order to better blend the water soluble mixed alcohols with diesel, a surfactant binder can be used. One such commercially available surfactant that is expected to work well is Octimax 4900 available from Octel Station.

The mixed alcohols can be volumetrically blended with diesel as follows: 50% mixed alcohols, 50% diesel. A diesel engine operating on such a fuel blend would likely need a one-time adjustment of its fuel injectors squirt and timing to achieve the proper air-fuel mixture and greatest torque output. Fleet vehicle applications could benefit in particular from such a fuel blend.

While engine and dynamometer tests were conducted using 10%, 20% and 30% volumes of $C_1$-$C_5$ mixed alcohol blend—it was determined that unadjusted diesel engines performed better on the 10% volume blend mixed alcohols. When the mixed alcohol is longer chain blend of $C_1$-$C_8$ or a $C_1$-$C_{10}$ blend—and utilized at only 5% and 6% volume concentrations with petroleum-derived diesel, no surfactant binder is necessary even in cold winter weather.

When combusting a longer chained blend of higher mixed alcohols at only 5% or 6% volumes, then all of the black smoke commonly associated with diesel engines under load disappears. Diesel drivers operating heavy 1-ton pickups, military-style Hummers and semi-trucks have recorded 22%, 24% and 28% increases in fuel economy with just 5-6% volume blends of $C_1$-$C_8$ higher mixed alcohols with no engine modifications.

The blending of the mixed alcohols into gasoline or diesel can occur in a variety of manners. The mixed alcohols can be splash blended into tanker trucks or rail cars. The movement of the tankers during transport will fully blend or mix the higher mixed alcohols into the gasoline or diesel. Another way of blending is to add the mixed alcohols to the fuel tank of a vehicle which is to combust the fuel. Again, the movement of the tank as the vehicle moves is sufficient to mix the petroleum-based, synthetic or bio-based fuel with the higher mixed alcohols. Still another way is to meter the mixed alcohols into a tank under pressure with the petroleum-based, synthetic or bio-based fuels.

The mixed alcohols can be used as a neat fuel in internal combustion engines, furnaces and in boilers. That is to say, the mixed alcohols need not be blended with other hydrocarbon fuels for combustion. The air/fuel ratios of engines, furnaces or boilers may need to be adjusted to operate on a mixture of alcohols alone as a neat fuel. The octane number of the neat mixed alcohol fuel is typically between 90 and 138 depending upon its $C_1$-$C_5$ or $C_1$-$C_8$ or $C_1$-$C_{10}$ formulation. The octane blending characteristics of the higher mixed alcohols are not linear.

Mixed alcohol's higher octane is particularly advantageous for aviation gasolines, which require an octane number from 100 to 120 or greater. In fact, an experimental aircraft made a transatlantic flight using ethanol alone. It is believed that the use of the mixed alcohols of the present invention, with its higher energy density and water-soluble abilities, will become a superior aircraft fuel over ethanol because of the increased octane, energy density (BTUs per pound) and water-soluble characteristics.

Several tests were conducted on the neat fuel mixed alcohols (see (I) above) to determine octane number. It was determined that the neat mixed alcohols would not ping in research engines designed to measure ping or pre-ignition. The octane of the neat mixed alcohols exceeded the upper threshold of these research engines even after being severely re-jetted.

In order to attempt to estimate the octane of the mixed alcohols, a test was conducted with the $C_1$-$C_5$ mixed alcohols blended at 5% volume with 85 octane reference fuel comprised of heptane and iso-octane. The research octane was measured at 118.9 using test method ASTM D 2699 and the motor octane was measured at 98.2 using test method ASTM D 2700. The calculated blended octane number (R+M)/2 was 108.6. Thus, 108.6 is a particular blending octane rating.

To further delineate an octane rating of the neat mixed alcohols of (I), a 50/50 mixture of iso-octane and heptane was used as a reference fuel reagent source with a known reference octane of 50. Then, the $C_1$-$C_5$ mixed alcohols were blended at 50% volume with iso-octane/heptane. The research engines needed to be re jetted before a ping could be detected in order to accommodate the measuring of an octane greater than 110. After re-jetting, research octane was mathematically calculated at 148.8, motor octane was calculated at 126.8 and the (R&M)/2 blending octane number was 137.8, using the test methods described above. The research engine would still not ping and pre-detonate even after being re-jetted to record octane levels of 120.

Experiments demonstrated that neat higher mixed alcohols $C_1$-$C_5$ formula provided a stand-alone octane above 130. The octane blending characteristics of the higher mixed alcohols are not linear. Therefore, the blending octane numbers provided by the $C_1$-$C_5$ or $C_1$-$C_8$ or $C_1$-$C_{10}$ blend of higher mixed alcohols will depend solely upon what hydrocarbon fuel products they are blended into and at what volume percentages.

Reid Vapor Pressure was measured at 4.6 psi using test method ASTM D 5191 for $C_1$-$C_5$ mixed alcohols. This mid-range Reid Vapor Pressure is particularly desired in warm climates where volatile organic compounds (VOC's) from evaporation of fuels is a source of pollution. The Reid Vapor Pressure of $C_1$-$C_5$ or $C_1$-$C_8$ higher mixed alcohols will typically be between 2.35-5.0 psi.

The heat of combustion of the $C_1$-$C_5$ neat fuel mixed alcohols was measured using test method ASTM D 240. The gross heat of combustion was 12,235 BTU/lb. and the net was 11,061 BTU/lb. It is believed that this is below the heat of combustion of gasoline. The use of $C_6$-$C_8$ alcohols in the neat fuel mixed alcohols have been experimentally demonstrated to further increase the heat of combustion to 90,400 BTU's per gallon, nearer to that of gasoline at 113,000 BTU's.

The drivability index was measured at 949 using test method ASTM D 86. It is preferred if the drivability index does not exceed 1250. Thus, the neat fuel mixed alcohols drivability index was well below the maximum amount.

A corrosion test was performed on the neat fuel mixed alcohols to determine compatibility with types of metals that might be used in an internal combustion engine. The corrosion test was conducted using test method ASTM D 4636. Iron, copper, aluminum, magnesium and cadmium showed zero milligrams of loss. This indicates that the neat fuel mixed alcohol is as good as gasoline or diesel or kerosene-based jet fuel in being compatible with engine components.

Other engine components are elastomers, which are used in seals, hoses, gaskets, and other flexible parts. Internal combustion engines are typically equipped with fluorinated elastomers in the gaskets, hoses and seals which are better suited to alcohol type fuels than non-fluorinated elastomers. The test method for fluorinated elastomer compatibility was ASTM D 471. After 240 hours, run at 50 degrees C., the volume change (percentage) was +25.81 to 26.01; hardness change (in points) was −22 to −23; the tensile strength change (percentage) was −41.40 to −45.93; and the elongation change (percentage) was −0.5763 to −0.6937.

The mixed alcohols can also be used as a near-neat fuel in Flex Fueled Vehicles (FFV's). The blend could be 95% mixed alcohols and 5% gasoline, by volume. The 5% gasoline increases the alcohol's Reid Vapor Pressure for cold temperature starts.

Still another formulation of the mixed alcohols is, by weight:

0.01-55% methanol 0.01-80% ethanol 0.01-35% propanol 0.01-30% butanol 0.01-20% pentanol 0.01-15% hexanol 0.01-13% heptanol 0.01-10% octanol 0.01-6% nananol 0.01-5% decanol.

A particular embodiment of the mixed alcohols is, by weight:

17.1% methanol 49.0% ethanol 17.3% propanol 7.0% butanol 5.1% pentanol 3.2% hexanol 0.3% heptanol 0.1% octanol.

The above mixed alcohols can be used in gasoline, in diesel or neat as a substitute fuel.

In addition, the mixed alcohol as discussed above can be used in heating oil, grades 1 or 2. The blended fuel can contain 1-30% by volume of the mixed alcohols, with the remainder being heating oil. The fuel is used for heating. For example, the fuel is typically combusted to heat homes or other structures.

Heating oil is quite similar to diesel with different additives, such as water solubilizers, bacterial inhibitors and additives which reduce deposit formation. The heating oil fuel with the mixed alcohols can contain these additives or in the alternative, the mixed alcohols may take the place of these additives. Heating oil is a middle distillate and contains paraffins (alkanes) cycloparaffins (cycloalkanes), aromatives and olefins from about $C_9$-$C_{20}$.

The mixed alcohols discussed above can also be used in bunker oil, grades A, B or C. The blended fuel can contain 0.01-30% by volume of the mixed alcohols, with the remainder being bunker oil. The fuel is commonly used in marine vessels and is combusted to power the power plants. The vessel derives propulsion and electricity generation from combusting the fuel.

Bunker oil is the most thick and sticky of the lower distillate residual fuels just ahead of the remaining portions of tars which are utilized to produce asphalt. Bunker A and B oils are lighter than Bunker C.

When blending the mixed alcohols with either heating oil or bunker oil, a mixing agent or surfactant binder can be used to prevent separation of the alcohols from the oil. One such surfactant is Octimax 4900, discussed above. Other commercial surfactant binders are also available. No surfactant binders are necessary when mixed alcohols are blended into gasoline or jet fuel.

Use of mixed alcohols blended with heating oil or bunker oil serves to mitigate air, water and land pollution.

The mixed alcohols can also be blended or mixed with finely ground petroleum coke or coal solid particles. The result is a coke or coal with mixed alcohol slurry which is thixotropic and can be pipelined, stored in tanks, or transported by rail, tanker truck, tanker ship or barge. Typically the coke or coal particles are less than or equal to 200 microns in size (for example, the particles can pass through a 100 mesh screen). This size is commonly used when coal is combusted in power plant steam boilers. The finer the solid carbons are ground the better that the alcohols will beneficiate and clean both coke or coal solids. Suspension properties of either coke-alcohol or coal-alcohol in a transportation or storage slurry of mixed alcohols are further increased by a finer grind of the solid particles. If water removal is a primary objective instead of transportation, the solid particles need not be finely ground.

Petroleum coke is a by-product of the oil refining process. Delayed coking, the most widely used process, uses heavy residual oil as a feedstock. The coal can be bituminous, anthracite or lignite variety.

The amount of coke or coal particles in the slurry is 70%-30% by weight. The remaining 30%-70% by weight are the mixed alcohols. A preferred slurry is 50% ground coke or coal and 50% mixed alcohols by weight. Another preferred slurry is about 40% ground coke or coal and 60% mixed alcohols by weight.

Both the coke-with-mixed alcohols and coal-with-mixed alcohols encompass various types of stable suspensions of any rank of coke or coal with mixed alcohols as well as the solids and liquid fuels derived from them.

Various techniques can be used to blend the mixed alcohols and the ground coke or coal. For example, mixing blades, screws, or grinding/blending mills can be used.

The invention of the use of mixed alcohol fuel as a blend stock to solid, ground hydrocarbons improves and enriches the properties of both petroleum coke and coal when combusted or gasified. It serves as a highly efficient freeze-proof media to transport ground coke or coal as slurry with mixed alcohols by pipeline, tanker truck, rail tanker, barge or tanker ship. At the destination, heat from the waste or other source separates the coke or coal from all, one, or a sequence of the mixed alcohols as desired for any number of conceived combustion or gasification applications. The ground coke or coal, which is highly activated and beneficiated (such as by diminishing water contamination and driving off nitrogen and sulfurs) in the processing with mixed alcohols, can be combusted in new or retrofitted furnaces, kilns or boilers and optimally in special combined cycle operations. In combined cycles, the mixed alcohols in total or any of its components, singly or combined, are combusted in a turbine generator and the separated pulverized coke or coal fires a combustion boiler supplying power to a steam turbine electrical generator.

Use of the coke-alcohol or coal-alcohol fuel provides higher combustion efficiency with lower environmental impact per unit of power output. Furthermore, in contrast to a transportation complex of coal-water slurries, the coke-alcohol or coal-alcohol fuel comprised of its uniquely invented mixed alcohol formula transfers only fuel and conserves water at the origin. The coke-alcohol and coal-alcohol fuel both provide a higher BTU content with relatively less sulfur, nitrogen and particulate matter. Use of higher mixed alcohols blended with either coke or coal serves to mitigate air, water and land pollution.

The beneficiated petroleum coke or coal can be separated from the higher mixed alcohols as desired for applications such as more efficient combustion in furnaces, kilns or boilers, or more efficient gasification to synthesis gas, most commonly used for electrical production or any gas-to-liquids (GTL) process for fuel production.

The higher mixed alcohols would be separated or removed from solid coke or coal through gravity drainage, vacuum filtration, heat (drying) or centrifuge. The remaining percentage of mixed alcohols present in the damp solid fuel would increase its combustion efficiency and also reduce harmful emissions. The coal-alcohol or coke-alcohol fuels may be stored for long periods of time as a thixotropic slurry without the settling or floating of solid particles thus the shiny will easily flow through positive displacement pumps.

Coal and coke typically contain water. Water moisture combines with and dilutes the mixed alcohols. When the mixed alcohols are removed, so too is a large quantity of the water moisture. Thus, the water content of the coke or coal is significantly reduced. Using a lignite ground coal sample the water moisture content was reduced from 22% to 6%, after most of the mixed alcohols were removed and the test sample was air-dried to damp conditions.

The mixed alcohols can also be used as a fuel blendstock or a thinning agent for viscous hydrocarbons such as petroleum heavy crude oil or tar sands bitumen. Some crude oils are heavy, meaning that it is dense and exhibits a high viscosity. Some heavy crude oils must be heated to become fluid. Tar sands are saturated with bitumen which is dark, asphalt-like oil. Bitumen is a hydrocarbon with a high viscosity.

By blending the mixed alcohols of any of the formulas I-IX into crude oil or bitumen, the crude oil and bitumen will flow easier and consequently be less expensive to transport especially in freezing conditions. For example, a blend of mixed alcohols and heavy, thick bitumen can be transported in pipelines. Heating requirements are reduced if not eliminated.

Once the fuel blend of mixed alcohols and heavy hydrocarbon oils reaches its destination, it can be combusted or refined with the mixed alcohols included. Alternatively, the mixed alcohols can be separated from the crude oil or bitumen by heating. For example, the first heat of a refinery can be used to separate out the mixed alcohols. Once separated, the mixed alcohols can be stored until re-blended into refined petroleum-based liquid hydrocarbon products to produce premium fuel blends.

The percentage of mixed alcohols used for form thixotropic slurry depends upon the hardness and water moisture content of coke or coal, and the specific blends of mixed alcohols.

The pipeline transportation feature of a slurry of mixed alcohols with coke, coal, heavy crude oils or bitumen provides alternatives to combustion at mine-mouth power plants or well-head refineries in close proximity to their source because these carbonaceous materials when blended with mixed alcohols are slurry pumped in a 'plug-flow' configuration requiring very little compression to travel through a pipeline. The coke or coal particles have minimal contact with the walls of the pipeline as they ride upon a thin layer of alcohols. The heavy thick, sticky viscous crude oil or bitumen are thinned with mixed alcohols for slurry consistency for pipelining or tanker transportation. The ground solids behave as a liquid when pumped through a pipeline or transport freighted as a stable suspension in barges, tanker ships, rail tankers or truck tankers. When compared to unit-training carloads of lump, thick or sticky carbonaceous fuel, blending with mixed alcohol for slurry in a pipeline configuration will provide a significant savings in transportation at any temperature because the mixed alcohols prevent freezing.

A slurry of ground coke or coal, heavy crude oils or bitumen blended with mixed alcohols becomes a thixotropic, stable suspension of carbonaceous particles held by polar alcohol molecules. In contrast, when blended with water, the solid carbonaceous materials do not chemically react or bind with the water but are only transported when under high pressure and turbulence in the pipeline, otherwise the particles separate with gravity and can plug the pipeline.

When blended together, the carbonaceous solids are bonded with mixed alcohols to form a liquid slurry which does not change with gravity or pressure fluctuation nor freeze in low temperatures during pipeline transportation or container storage.

Water moisture within the ground coke or coal is bound, held and liquefied by highly polar mixed alcohols and becomes another of the primary benefits when combusting or gasifying the dried, slightly damp slurry of coke or coal beneficiated by mixed alcohols.

Ground coke or coal in a mixed alcohol slurry can be centrifuged and dried to slightly damp conditions which will combust lower in ash, sulfur and nitrogen than the original coke or coal materials.

When compared to transporting train-car tonnages of lump coke or coal, the mixed alcohol-based slurry in a pipeline configuration will provide owner/operators with a significant savings in transportation costs of either coke or coal solids.

Water is conserved which is especially valuable when coal in arid regions is being converted into electricity for transmission by wire or when ground coal is alternatively transported as a coal-water slurry and then dried and combusted at water surplus areas.

Petroleum coke or coal combined with mixed alcohols can be combusted directly in retrofitted or newly designed, highly efficient boilers. When the alcohols are separated from the carbonaceous solids through mechanical centrifuge, steam heat or other methods, this volume of fuel alcohols separated from the slimy can then be efficiently used as a biodegradable liquid fuel for internal combustion engines, furnaces, boilers, kilns, gasifiers or re-used for additional solid coke or coal slurry beneficiation and transportation.

Compared with conventional coal-fired electric power generation, a fully integrated system of coke or coal feedstock beneficiated with mixed alcohols provides lower fuel consumption per unit of electricity generated and reduced stack emissions of carbon dioxide, sulfur oxides, nitrogen oxides and ultra-fine particulates.

Coke or coal slurry integrating mixed alcohols features universal economic and environmental advantages for the world's expanding energy requirements. This technology of coke or coal slurry with mixed alcohols is suitable for extremes of climate and geological conditions and ideal for the growth of clean energy demands.

This combination of a coke or coal slurry with mixed alcohols provides a higher BTU, higher octane and greater efficiencies to energy conversion operations when compared to traditional energy technologies. This slurry features improvements of energy and water balances compared to characteristics of coal-water slurries for transportation and combustion advantages in an improved environmental manner.

The mixed alcohol fuel may also be utilized as a thinning agent when blended into viscous, extra thick or heavy crude oils or tar sands bitumen heavy oils, ground solids of petroleum coke or ground coal thus making these easier to transport in a pipeline or tanker.

A slurry of petroleum coke or coal or crude oil or bitumen blended with mixed alcohols can be economically transported large distances for use as fuel in power plants or liquid fuel supplies which are located long distance from mines and petroleum refineries. The power plants can be located at advantageous sites from the standpoint of power transmission system interconnects and cooling water availability. The identifiable economic benefits of a project will be derived from providing a means to efficiently and economically use these carbonaceous resources in any geographic area.

For comparative purposes the cost of the rights-of-way for coke or coal with mixed alcohol slurry pipelines will be the same as they would be for coal-water slurry pipelines, which are not considered to be practical or economical in most cases. The slurry pipelines can be much shorter in some cases because there are no slope limitations as there will be with the coal-water slurry pipelines, and therefore more direct routes can be utilized. Also the pipelines do not need to be buried deeply to prevent freezing when utilizing the slurry with mixed alcohols.

The coke or coal blended with mixed alcohols slurry pipelines can often use plastic pipe instead of abrasion resistant steel that have been previously used for coal-water slurries. Steel pipe will be used for these slurry pipelines where steep inclines or declines are encountered and where resultant pressures would exceed the ratings of plastic pipe. The coke/coal/mixed alcohols does not abrade pipe or pumps as the coal-water slurries do because of many layers of attached alcohol molecules which coat the surfaces of the coal particles.

Low pipeline pressures and centrifugal pumps can be used instead of costly piston or plunger pumps required for the high pressures needed to maintain turbulent flow for coal-water slurry pipelines. Since only the slurry is being transported in the pipeline about one-half the volume will be required to provide equal quantities of fuel when compared to the coal-water slurries using low moisture-content coals. If the coal moisture content is high, the volume could be as much as three times compared to that of coke or coal blended with mixed alcohols to provide the same amount of fuel value. This comparison clearly identifies the large savings available in pipeline transportation costs for coke or coal slurry with mixed alcohols over conventional coal-water slurries.

This savings in transportation has unique advantage when compared to building new railroads, pipelines or specialized tankers for heavy hydrocarbon product delivery from remote areas to the coal-fired power plants or petroleum refineries. The environmental advantages include reduced use of water and reduction of harmful emissions due to the use of mixed alcohols blended with hydrocarbon fuels.

In addition to coal and coke, the mixed alcohols MX can be mixed with biomass. Biomasses are organic material typically derived from living things. Common examples of biomass include food crops, wood waste, animal manure, algae, construction debris (such as wood framing, etc.), municipal solid waste, food waste and yard waste.

The mixed alcohols (using any one of the formulas I-Do are mixed in with the biomass. The amount of biomass to mixed alcohols is 30-70% by weight biomass, with the remainder mixed alcohols. Once mixed, a slurry is formed. The slurry is easily transportable in the same manner as the coal or coke stuffy.

Once the biomass shiny reaches its destination, a large portion of the mixed alcohols are removed, using the same techniques as with coal or coke. The biomass is then combusted or gasified with some of the mixed alcohols still remaining in the biomass. These mixed alcohols increase the BTU values of the biomass.

The foregoing disclosures and examples are merely illustrative of the principles of this invention and are not to be interpreted in a limiting sense.

The invention claimed is:

1. A water moisture content reduction method for petroleum coke or coal, comprising the steps of:

a) providing a quantity of mixed alcohols, comprising by volume:

0.01-55% methanol 0.01-80% ethanol 0.01-35% propanol 0.01-30% butanol 0.01-20% pentanol;

b) mixing the mixed alcohols with the coke or coal, the coke or coal containing water, with at least some of the water mixing with the mixed alcohols;

c) removing a portion of the mixed alcohols from the coke or coal, wherein the water moisture content of the coke or coal is reduced.

2. The water reduction of claim 1 further comprising the step of grinding the coke or coal to pass through 100 mesh before mixing with the mixed alcohols.

3. The water reduction of claim 1, wherein the step of providing a quantity of mixed alcohols by volume further comprises the step of providing:

0.01-15% hexanol 0.01-13% heptanol 0.01-10% octanol.

4. The water reduction of claim 3, wherein the step of providing a quantity of mixed alcohols by volume further comprises the step of providing:

0.01-6% nananol 0.01-5% decanol.

5. A transportation method for coke or coal, comprising the steps of:

a) providing a quantity of mixed alcohols, comprising by volume:

0.01-55% methanol 0.01-80% ethanol 0.01-35% propanol 0.01-30% butanol 0.01-20% pentanol;

b) mixing the mixed alcohols with the coke or coal so as form a thixotropic slurry;

c) transporting the slurry in a pipeline, barge, tanker truck, ship tanker or rail tanker.

6. The transportation method of claim 5 wherein the step of mixing the mixed alcohols with the coke or coal further comprises mixing 30% to 70% by weight of the mixed alcohols into the ground coke or coal.

7. The transportation method of claim 5, wherein the step of providing mixed alcohols further comprises providing by volume:

0.01-15% hexanol 0.01-13% heptanol 0.01-10% octanol.

8. The transportation method of claim 7, wherein the step of providing mixed alcohols further comprises providing by volume:

0.01-6% nananol 0.01-5% decanol.

9. The transportation method of claim 5, further comprising the steps of removing the mixed alcohols from the transported coke or coal.

10. The transportation method of claim 9, further comprising combusting or gasifying the transported coke or coal.

11. A transportation method for heavy crude oil or bitumen, comprising the steps of:

a) providing a quantity of mixed alcohols, comprising by volume:

0.01-55% methanol 0.01-80% ethanol 0.01-35% propanol 0.01-30% butanol 0.01-20% pentanol;

b) blending the mixed alcohols with the heavy crude oil or bitumen so as form a thixotropic slurry;

c) transporting the slurry in a pipeline, barge, tanker truck, ship tanker or rail tanker.

12. The transportation method of claim 11 wherein the step of blending the mixed alcohols with the heavy crude oil and bitumen further comprising mixing 5% to 50% by weight of the mixed alcohols into the heavy crude oil and bitumen.

13. The transportation method of claim 11, wherein the step of providing mixed alcohols further comprises providing by volume:

0.01-15% hexanol 0.01-13% heptanol 0.01-10% octanol.

14. The transportation method of claim 13, wherein the step of providing mixed alcohols further comprises providing by volume:

0.01-6% nananol 0.01-5% decanol.

15. The transportation method of claim 11, further comprising the steps of removing the mixed alcohols from the transported heavy crude oil or bitumen.

16. The transportation method of claim 15, further comprising refining, combusting or gasifying the transported heavy crude oil or bitumen.

17. A transportation method for biomass, comprising the steps of:

a) providing a quantity of mixed alcohols, comprising by volume:

0.01-55% methanol 0.01-80% ethanol 0.01-35% propanol 0.01-30% butanol 0.01-20% pentanol;

b) mixing the mixed alcohols with the biomass so as form a slurry;

c) transporting the slurry in a pipeline, barge, tanker truck, ship tanker or rail tanker.

18. The transportation method of claim 17, wherein the step of mixing the mixed alcohols with the biomass further comprises mixing 30% to 70% by weight of the mixed alcohols into the biomass.

19. The transportation method of claim 17, wherein the step of providing mixed alcohols further comprises providing by volume:

0.01-15% hexanol 0.01-13% heptanol 0.01-10% octanol.

20. The transportation method of claim 19, wherein the step of providing mixed alcohols further comprises providing by volume:

0.01-6% nananol 0.01-5% decanol.

21. The transportation method of claim 17, further comprising the steps of removing the mixed alcohols from the transported biomass.

22. The transportation method of claim 21, further comprising combusting or gasifying the transported biomass.

* * * * *